US008567384B2

(12) United States Patent
Oishi et al.

(10) Patent No.: US 8,567,384 B2
(45) Date of Patent: Oct. 29, 2013

(54) SLICING METHOD AND WIRE SAW APPARATUS

(75) Inventors: Hiroshi Oishi, Nishishirakawa (JP); Koji Kitagawa, Nishishirakawa (JP); Hideo Kudo, Nishishirakawa (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 933 days.

(21) Appl. No.: 12/449,484

(22) PCT Filed: Jan. 24, 2008

(86) PCT No.: PCT/JP2008/000081

§ 371 (c)(1), (2), (4) Date: Aug. 11, 2009

(87) PCT Pub. No.: WO2008/108051

PCT Pub. Date: Sep. 12, 2008

(65) Prior Publication Data

US 2010/0089377 A1 Apr. 15, 2010

(30) Foreign Application Priority Data

Mar. 6, 2007 (JP) ..... 2007-055757

(51) Int. Cl.
*B28D 1/08* (2006.01)

(52) U.S. Cl.
USPC ..... 125/21; 125/16.01; 125/16.02; 451/7; 451/53

(58) Field of Classification Search
USPC ..... 451/7, 53, 59; 125/12, 16.01, 16.02, 21
See application file for complete search history.

(56) References Cited

U.S. PATENT DOCUMENTS 5,778,869 A * 7/1998 Toyama ..... 125/16.02
6,178,961 B1 * 1/2001 Nagatsuka et al. ..... 125/21

(Continued)

FOREIGN PATENT DOCUMENTS

JP A-4-46759 2/1992
JP A-9-262826 10/1997

(Continued)

OTHER PUBLICATIONS

Office Action issued in Japanese Patent Application No. 2007-055757 dated May 31, 2011 (partial translation).
Chinese Office Action dated Dec. 12, 2011 in Chinese Patent Application No. 2008800061169 (with partial translation).
Chinese Office Action dated Jun. 12, 2010 in corresponding Chinese Application No. 2008800061169 (with partial translation).

*Primary Examiner* — Eileen P. Morgan
(74) *Attorney, Agent, or Firm* — Oliff & Berridge, PLC

(57) ABSTRACT

The invention is directed to a method for slicing an ingot in the form of a wafer by winding a wire around a plurality of grooved rollers and pressing the wire against the ingot while making the wire travel and supplying slicing slurry to the grooved rollers, in which when the ingot is sliced, an amount of displacement of the ingot changing in an axial direction is measured and an amount of axial displacement of the grooved rollers is controlled so as to correspond to the measured amount of axial displacement of the ingot, and thereby, the ingot is sliced while controlling a relative position of the wire relative to an entire length of the ingot changing in the axial direction. As a result, a slicing method and a wire saw apparatus are provided that can perform slicing in such a way that a Bow or a Warp in a wafer obtained by slicing can be reduced, for example, by controlling a slicing path built into an ingot so that, in particular, the slicing path becomes flattened.

3 Claims, 11 Drawing Sheets

(56) References Cited

U.S. PATENT DOCUMENTS

| | | | | |
|---|---|---|---|---|
| 6,652,356 | B1 * | 11/2003 | Ariga | 451/7 |
| 6,773,333 | B2 | 8/2004 | Lundt et al. | |
| 7,959,491 | B2 * | 6/2011 | Kitagawa | 451/7 |
| 2002/0174861 | A1 * | 11/2002 | Lundt et al. | 125/21 |
| 2007/0178807 | A1 * | 8/2007 | Gupta et al. | 451/5 |
| 2010/0089377 | A1 * | 4/2010 | Oishi et al. | 125/16.02 |
| 2010/0258103 | A1 * | 10/2010 | Kitagawa | 125/21 |
| 2011/0088678 | A1 * | 4/2011 | Kitagawa | 125/16.01 |

FOREIGN PATENT DOCUMENTS

| | | |
|---|---|---|
| JP | A-2003-1624 | 1/2003 |
| JP | A-2003-145406 | 5/2003 |
| JP | A-2005-103683 | 4/2005 |

* cited by examiner (A)

(B)

SLICING METHOD AND WIRE SAW APPARATUS

TECHNICAL FIELD

The present invention relates to a slicing method for slicing a large number of wafers from a silicon ingot, an ingot of a compound semiconductor, or the like, by using a wire saw apparatus and to a wire saw apparatus.

BACKGROUND ART

In recent years, it has been sought after that wafers become larger, and, as the wafers become larger, in slicing of an ingot a wire saw apparatus is primarily used.

The wire saw apparatus is an apparatus for slicing out a large number of wafers at the same time by making a wire (high-tensile steel wire) travel at high speed and pressing an ingot (work) against the wire to slice the ingot while spraying slurry on the wire (Japanese Unexamined Patent Publication (Kokai) No. 9-262826).

Here, in FIG. 12, an outline of an example of a common wire saw apparatus is shown.

As shown in an overall view of FIG. 12(A), a wire saw apparatus 101 mainly includes a wire 102 for slicing an ingot, grooved rollers 103 (wire guides) around which the wire 102 is wound, a mechanism 104 for providing the wire 102 with tension, a mechanism 105 for feeding the ingot to be sliced, and a mechanism 106 for supplying slurry at the time of slicing.

The wire 102 is unreeled from one wire reel 107, and enters the grooved rollers 103 via a traverser 108 through the tension-providing mechanism 104 including a powder clutch (constant torque motor 109), a dancer roller (deadweight)(not shown), etc. After the wire 102 is wound around the grooved rollers 103 about 300 to 400 times, it is reeled onto a wire reel 107' through the other tension-providing mechanism 104'.

Moreover, the grooved roller 103 is a roller formed as a steel cylinder around which polyurethane resin (a shell unit) is press-fitted, the roller having grooves cut on the surface thereof at a predetermined pitch, and is configured such that the wire 102 wound around the roller can be driven in the reciprocating direction by a motor 110 for driving in a predetermined cycle.

Here, the grooved roller 103 will be further explained. A grooved roller shown in FIG. 13 is taken up as an example of the conventionally used grooved roller 103. At both ends of the grooved roller 103, bearings 121 and 121' supporting a shaft 120 of the grooved roller are provided. For example, the bearing 121 is of the radial type, and the grooved roller 103 can extend in an axial direction toward the bearing 121 of the radial type. On the other hand, the bearing 121' is of the thrust type, and the grooved roller 103 is configured so as not to extend toward the bearing 121' of the thrust type easily. That is, the grooved roller is configured such that it can extend in only one direction entirely, in the axial direction.

Moreover, some grooved rollers are configured such that both the bearings 121 and 121' are of the radial type, and the grooved roller can extend back and forth in an axial direction.

When an ingot is sliced, the ingot is fed to the wire 102 wound around the grooved rollers 103 by the ingot-feed mechanism 105 as shown in FIG. 12(B). This ingot-feed mechanism 105 includes an ingot-feed table 111 for feeding an ingot, an LM guide 112, an ingot clamp 113 for holding the ingot, a slice pad plate 114, and the like, and can feed the ingot fastened to the end thereof at a previously programmed feed speed by driving the ingot-feed table 111 along the LM guide 112 by computer control.

And, as shown in FIG. 12(A), nozzles 115 are provided near the grooved rollers 103 and the wound wire 102, whereby it is possible to supply slurry which is a liquid in which GC (silicon carbide) abrasive grains, for example, are dispersed to the grooved rollers 103 and the wire 102 from a slurry tank 116 at the time of slicing. In addition, a slurry chiller 117 is connected to the slurry tank 116, making it possible to adjust the temperature of the slurry to be supplied.

An ingot is sliced by using such a wire saw apparatus 101 and applying appropriate tension to the wire 102 by using the wire-tension-providing mechanism 104, while making the wire 102 travel in the reciprocating direction with the motor 110 for driving.

Currently, it is common to perform slicing by using a wire having a width of 0.13 mm to 0.18 mm, applying a tension of 2.5 kgf to 3.0 kgf thereto, and making the wire travel in the reciprocating direction at an average speed of 400 m/min to 600 m/min in a cycle of 1 c/min to 2 c/min (30 s/c to 60 s/c).

DISCLOSURE OF INVENTION

Previously, slicing an ingot was performed by using the above-described common wire saw apparatus. However, when the shape of the wafer actually obtained by slicing was checked, a Bow or a Warp was generated. The Bow or the Warp is one of the important qualities in slicing of a semiconductor wafer, and a further reduction thereof is required as the product quality demand is increased.

Thus, as a result of an intensive study on an ingot slicing method using a wire saw apparatus, the inventors have found out that the cause of the generation of the Bow or the Warp is a matter generated by overlapping influences of, broadly divided into,

- the thermal expansion of the grooved rollers and the ingot,
- the straightness of work feed, and
- the deflection of the wire during slicing (in a wafer out-of-plane direction). Furthermore, they have found out that, among them, the influence of the thermal expansion of the grooved rollers and the ingot is particularly large, and improving this is most effective in obtaining an effect on improving the Bow or the Warp.

Hereinafter, the influence of the thermal expansion of the grooved rollers and the ingot on a Bow or a Warp will be described in detail.

First, a case in which the ingot is maintained at a constant temperature and only the grooved roller thermally expands during slicing will be described. The grooved roller thermally expands due to an increase in slurry temperature caused by heat generated by the sliced ingot, or via conduction of heat from the wire. Depending on the type and combination of the bearings in the above-described grooved roller for supporting it, there are a case in which thermal expansion occurs in only one direction in the axial direction as shown in FIG. 14(A) and a case in which thermal expansion occurs uniformly in both directions (front-back direction) in the axial direction as shown in FIG. 14(B). Therefore, there are a case (FIG. 14(A)) in which a slicing path in an ingot is displaced in only one direction in the axial direction and a case (FIG. 14(B)) in which it is displaced in a symmetrical shape in both directions (front-back direction) in the axial direction.

Next, a case in which the grooved roller does not thermally expand and only the ingot thermally expands during slicing will be discussed. When the temperature of the ingot measured by using, for example, a thermocouple during slicing is converted into the amount of thermal expansion, as shown in FIG. 14(C), in both directions in the axial direction, the ingot thermally expands at the early stage of slicing and thermally contracts at nearly the end of slicing, depending on a slicing load at different times.

Then, slicing paths observed when the above-described thermal expansion of the grooved roller and thermal expansion/contraction of the ingot are built into the ingot at the same time are shown in FIGS. 15(A) and 15(B).

FIG. 15(A) is a slicing path corresponding to a case in which the grooved rollers thermally expand in only one direction in the axial direction, and FIG. 15(B) is a slicing path corresponding to a case in which the grooved rollers thermally expand uniformly in both directions (front-back direction) in the axial direction.

As described above, with a conventional slicing method and a conventional wire saw apparatus, the slicing paths are those shown in FIGS. 15(A) and 15(B), and a Bow or a Warp is generated in most of the wafers obtained by slicing.

The present invention has been made in view of the above-described problems, and an object thereof is to provide a slicing method and a wire saw apparatus that can perform slicing in such a way that a Bow or a Warp in a wafer obtained by slicing can be reduced, for example, by controlling a slicing path built into an ingot so that, in particular, the slicing path becomes flattened.

To solve the above problems, the invention provides a method for slicing an ingot in the form of a wafer by winding a wire around a plurality of grooved rollers and pressing the wire against the ingot while making the wire travel and supplying slicing slurry to the grooved rollers, wherein, when the ingot is sliced, an amount of displacement of the ingot changing in an axial direction is measured and an amount of axial displacement of the grooved rollers is controlled so as to correspond to the measured amount of axial displacement of the ingot, and thereby, the ingot is sliced while controlling a relative position of the wire relative to an entire length of the ingot changing in the axial direction.

Since it is difficult to control thermal expansion/contraction itself of the ingot, in the slicing method of the invention, when the ingot is sliced, the amount of displacement of the ingot changing in an axial direction is first measured. Then, the amount of axial displacement of the grooved rollers is controlled so as to correspond to the measured amount of axial displacement of the ingot. This makes it possible to slice the ingot while controlling the relative position of the wire relative to the entire length of the ingot changing in the axial direction, and adjust a slicing path in the ingot so as to be an intended slicing path. For example, it is possible to flatten a slicing path and reduce a Bow or a Warp in each wafer after slicing remarkably.

At this time, it is possible that by passing cooling water through shafts of the grooved rollers and adjusting a temperature and/or a flow rate of the cooling water, the amount of axial displacement of the grooved rollers is controlled.

In this way, by passing cooling water through the shafts of the grooved rollers and controlling the temperature and/or the flow rate of the cooling water, it is possible to control the amount of axial displacement of the grooved rollers easily and accurately.

Then, it is possible that the measurement of the amount of axial displacement of the ingot is performed by using a thermocouple or a differential displacement gage.

In this way, the measurement of the amount of axial displacement of the ingot can be performed by a simple method using a thermocouple or a differential displacement gage.

Moreover, it is preferable that a profile of the amount of axial displacement of the ingot relative to a depth of cut is generated from the measured amount of axial displacement of the ingot, and, based on the profile thus generated, the amount of axial displacement of the grooved rollers is controlled.

In this way, by generating a profile of the amount of axial displacement of the ingot relative to the depth of cut from the measured amount of axial displacement of the ingot, and, based on the profile thus generated, controlling the amount of axial displacement of the grooved rollers, it is possible to control the amount of axial displacement of the grooved rollers quite easily without effort.

Moreover, the invention provides a wire saw apparatus having a wire wound around a plurality of grooved rollers and slicing an ingot in a form of a wafer by pressing the wire against the ingot while making the wire travel and supplying slicing slurry to the grooved rollers, the wire saw apparatus at least including: an ingot displacement measuring mechanism for measuring an amount of axial displacement of the ingot to be sliced; and a grooved roller displacement control mechanism for controlling an amount of axial displacement of the grooved rollers so as to correspond to the amount of axial displacement of the ingot measured by the ingot displacement measuring mechanism by feeding the amount of axial displacement of the grooved rollers back to a temperature and/or a flow rate of cooling water passed through shafts of the grooved rollers.

In this way, since the wire saw apparatus of the invention is provided with the ingot displacement measuring mechanism for measuring the amount of axial displacement of the ingot to be sliced, it can measure the amount of axial displacement of the ingot, and, since it is provided with the grooved roller displacement control mechanism for controlling the amount of axial displacement of the grooved rollers so as to correspond to the amount of axial displacement of the ingot measured by the ingot displacement measuring mechanism by feeding the amount of axial displacement of the grooved rollers back to the temperature and/or the flow rate of cooling water passed through the shafts of the grooved rollers, it can control the amount of axial displacement of the grooved rollers so as to correspond to the amount of axial displacement of the ingot. In addition, since the control is performed by feedback to the temperature and/or the flow rate of cooling water passed through the shafts of the grooved rollers, it is possible to perform the control easily and accurately.

With the slicing method and the wire saw apparatus of the invention, it is possible to control the amount of axial displacement of the grooved rollers during slicing so as to correspond to the amount of axial displacement of the ingot which is difficult to control. This makes it possible to control the relative position of the wire wound around the grooved rollers, the relative position relative to the entire length of the ingot. That is, it is possible to control a slicing path, and, in particular, by flattening the slicing path, it is possible to reduce a Bow or a Warp.

BEST MODE FOR CARRYING OUT THE INVENTION

Hereinafter, an embodiment of the invention is explained; the invention, however, is not limited thereto.

Figure 15:
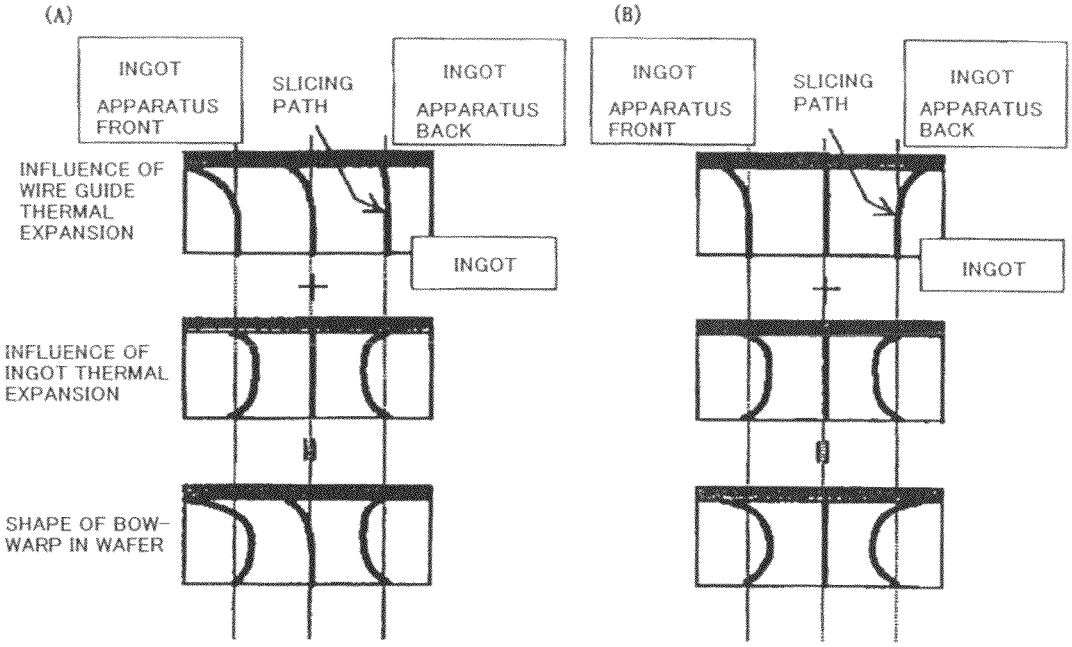
FIG. 15(A) is an explanatory diagram showing an example of a slicing path when thermal expansion (one direction) of the grooved roller and thermal expansion/contraction of an ingot when the ingot is sliced are taken into consideration. (B) is an explanatory diagram showing an example of a slicing path when thermal expansion (front-back direction) of the grooved roller and thermal expansion/contraction of an ingot when the ingot is sliced are taken into consideration.

As described above, when an ingot is sliced by using a conventional slicing method and a conventional wire saw apparatus, a slicing path changes in an axial direction as shown in FIG. 15 due to, in particular, thermal expansion of a grooved roller or an ingot in an axial direction, and a large Bow or a large Warp is generated in a wafer obtained by slicing. To address this, a slicing method or the like for suppressing a change in an ingot or a grooved roller in an axial direction by, for example, spraying slurry on the ingot or the like in order to eliminate a change in a slicing path in an axial direction has been studied.

However, the inventors have found out that it is difficult to suppress a change in an ingot, in particular, in an axial direction, and, even when an attempt is made to control it by spraying slurry as described above, the ingot actually changes a little, which makes such measures inadequate as measures to prevent a Bow or the like.

Thus, the inventors have conceived of reducing Bows or the like by adjusting a slicing path by changing both the grooved roller and the ingot in an axial direction in the same manner because it is, after all, impossible to eliminate changes in both the grooved roller and the ingot in an axial direction. And, they have found out that all that is needed is, since it is difficult to control a change in the ingot, in particular, in an axial direction, to adjust the relative position of a wire appropriately relative to the entire length of the ingot during slicing by controlling the amount of axial displacement of the grooved roller so as to correspond to the amount of axial displacement of the ingot, and have completed the invention.

Hereinafter, a wire saw apparatus and a slicing method of the invention will be explained in detail with reference to the drawings; the invention, however, is not limited thereto.

Figure 1:
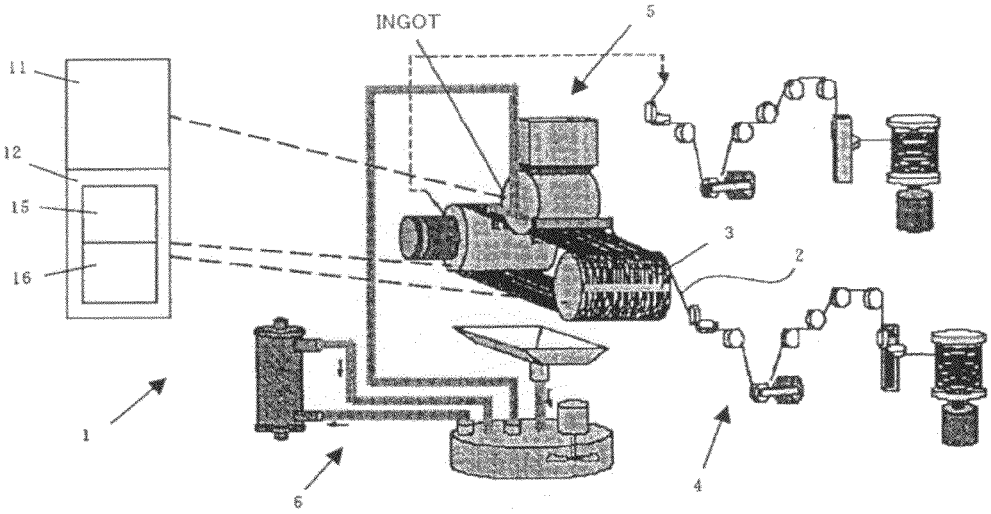
FIG. 1 is a schematic diagram showing an example of a wire saw apparatus of the invention.

In FIG. 1, an example of a wire saw apparatus of the invention is shown.

A wire saw apparatus 1 of the invention has, first of all, as a main body unit, as is the case with the conventional wire saw apparatus 101, a wire 2 for slicing an ingot, a grooved roller 3 (wire guide) around which the wire 2 is wound, a mechanism 4 for providing the wire 2 with tension, a mechanism 5 for feeding an ingot to be sliced, and a mechanism 6 for supplying slurry at the time of slicing.

Figure 12:
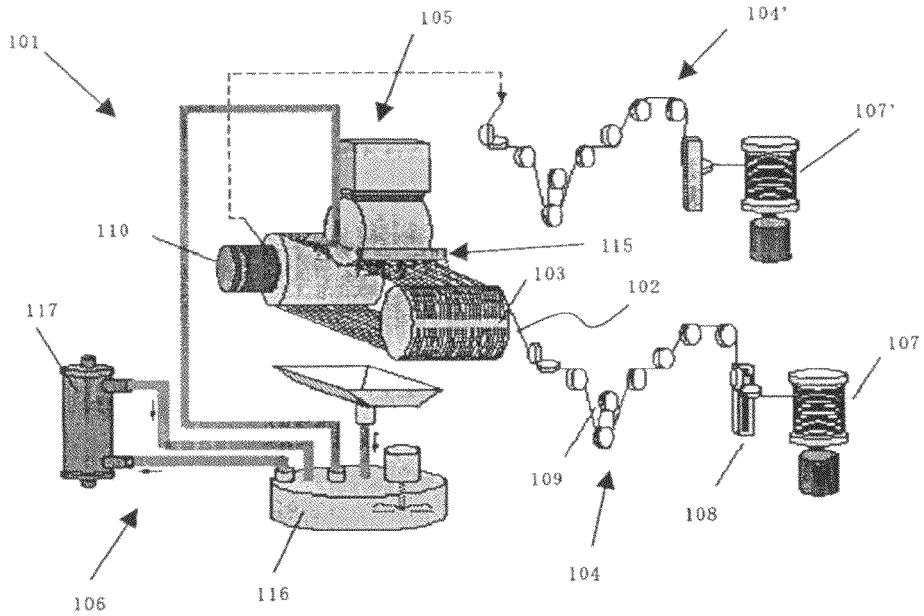
FIG. 12 is a schematic diagram showing an example of a wire saw apparatus used in a conventional slicing method. (A) is an overall view, and (B) is a schematic diagram of an ingot-feed mechanism.
Figure 12:
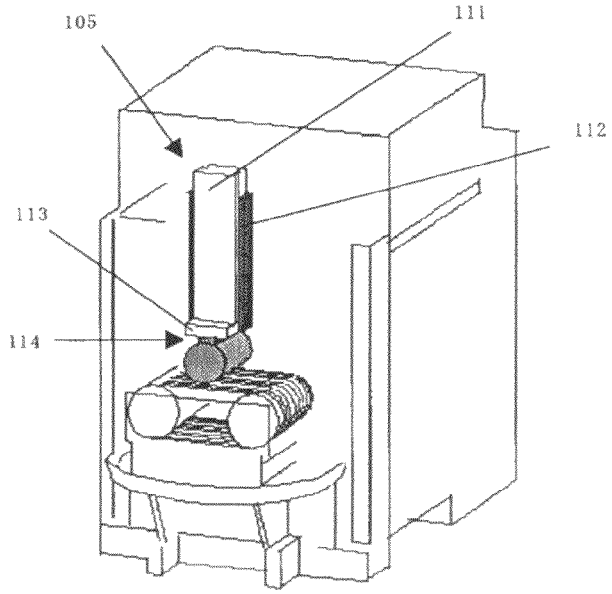
Figure 13:
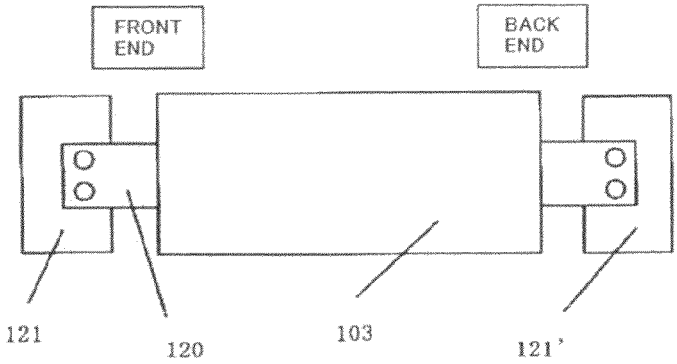
FIG. 13 is a schematic plan view showing an example of the structure of a grooved roller.

The wire 2, the wire-tension-providing mechanism 4, the ingot-feed mechanism 5, and the slurry-supply mechanism 6 may be the same as those of the wire saw apparatus 101 of FIG. 12 used in the conventional slicing method.

Incidentally, in the invention, to control the amount of axial displacement of the grooved roller 3 so as to correspond to the amount of displacement of the ingot changing in both directions (front-back direction) in the axial direction, both bearings of the grooved roller 3 are of the radial type, and the grooved roller 3 can be configured such that it can extend back and forth in an axial direction.

And, the wire saw apparatus 1 of the invention further includes an ingot-displacement-measuring mechanism 11 for measuring the amount of axial displacement of the ingot at the time of slicing and a grooved-roller-displacement-control mechanism 12 for controlling the amount of axial displacement of the grooved roller 3, by feeding it back to the temperature and/or the flow rate of cooling water passed through the shaft of the grooved roller, so as to correspond to the amount of axial displacement of the ingot measured by the ingot-displacement-measuring mechanism 11.

Figure 2:
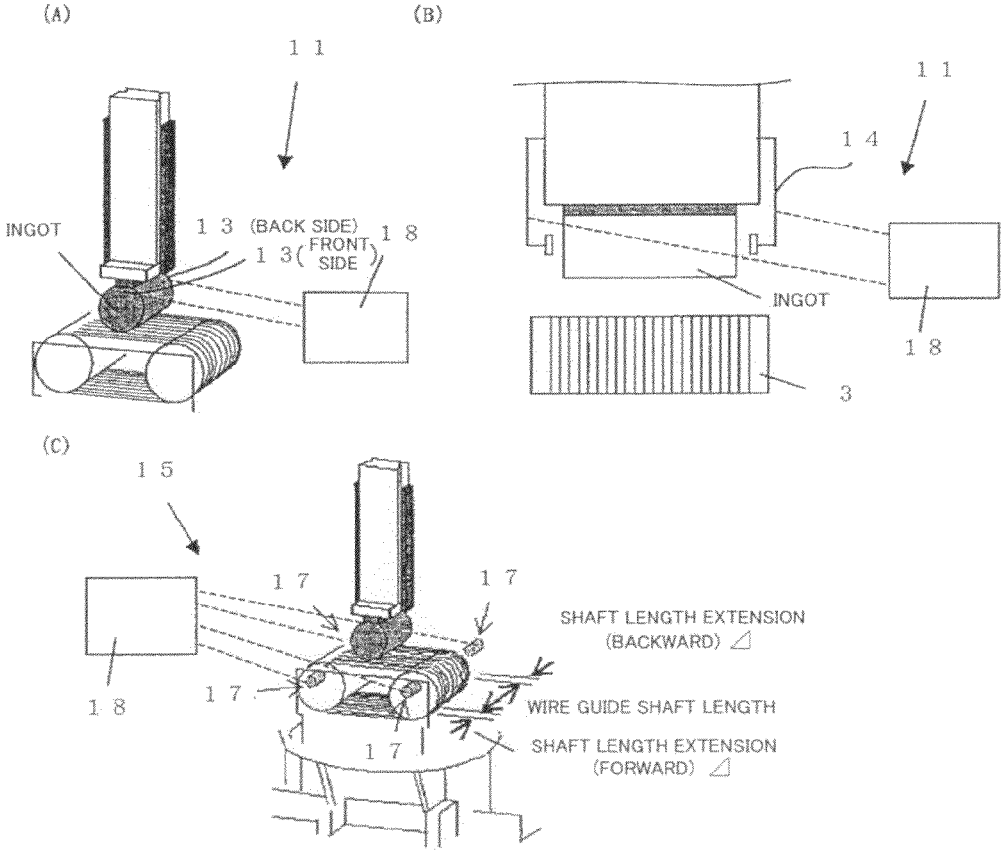
FIG. 2(A) is an explanatory diagram showing an example of an ingot to which thermocouples are attached. (B) is an explanatory diagram showing an example of an ingot for which a differential displacement gage is placed. (C) is an explanatory diagram showing an example of a grooved roller for which eddy-current sensors are placed.

As the ingot-displacement-measuring mechanism 11, the one using a thermocouple 13, for example, can be adopted. That is, an example thereof is the one in which the thermocouple 13 is attached to the front and back sides of the ingot in an ingot axial direction, and a computer 18 which calculates and processes the amount of axial displacement of the ingot by converting the temperature of the ingot measured by the thermocouple 13 into the amount of thermal expansion is provided. In FIG. 2(A), an example of a case in which the thermocouples 13 are attached to the ingot is shown.

Moreover, in addition to this, it is possible to adopt the one using a differential displacement gage 14 instead of using the thermocouple 13. That is, the amount of axial displacement of the ingot may be measured by attaching a supporting unit of the displacement gage to what is resistant to thermal expansion (for example, the main body of the wire saw apparatus 1

) and disposing a measuring unit on both sides of the ingot in an axial direction. The differential displacement gage 14 is connected to the computer 18, and can process the measured data. In FIG. 2(B), an example of a case in which the differential displacement gage is placed for the ingot is shown.

The ingot-displacement-measuring mechanism 11 is not particularly limited, and it is sufficient that the one may be able to measure the amount of axial displacement of the ingot accurately and quickly at the time of slicing. The mechanism using the above-described thermocouple 13 or differential displacement gage 14 is preferable because it can perform the measurement easily and accurately.

Next, the grooved-roller-displacement-control mechanism 12 will be described.

The grooved-roller-displacement-control mechanism 12 is divided broadly into a grooved-roller-displacement-measuring unit 15 for measuring the amount of axial displacement of the grooved roller 3 and a cooling-water-adjusting unit 16 for adjusting the temperature and the flow rate of the cooling water passed through the shaft of the grooved roller 3.

First, the grooved-roller-displacement-measuring unit 15 can be configured such that it can measure the amount of axial displacement by placing an eddy-current sensor 17, for example, near the both sides of the grooved rollers 3 in an axial direction. In FIG. 2(C), an example of a case in which the eddy-current sensors 17 are placed for the grooved rollers 3 is shown. Means of measuring the amount of axial displacement of the grooved roller 3 is not limited to that described above. However, the use of the eddy-current sensor is preferable because it makes it possible to perform noncontact measurement with a high degree of precision.

Moreover, the cooling-water-adjusting unit 16 has a heat exchanger and a pump provided therein, and can adjust the temperature and the flow rate of the cooling water passed through the shaft of the grooved roller 3.

Figure 3:
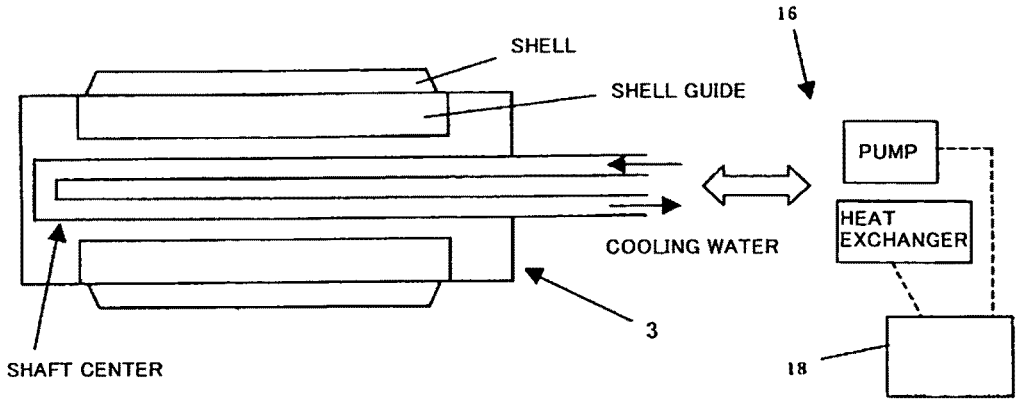
FIG. 3 is an explanatory diagram showing an example of a cross section of a grooved roller.

Here, the cooling-water-adjusting unit 16 will be explained by using a sectional view of the grooved roller 3 shown in FIG. 3. The grooved roller 3 has a structure in which a resin unit (shell) having grooves in which the wire 2 is wound are formed as an outermost layer, a shell guide is provided inside the resin unit, and a shaft center is provided inside the shell guide. The grooved roller 3 used in the wire saw apparatus 1 of the invention has a structure in which the cooling water whose temperature and flow rate are adjusted by the cooling-water-adjusting unit 16 is passed through the shaft center unit.

And, the grooved-roller-displacement-control mechanism 12 is provided with a computer for performing feedback processing on the data of the amount of axial displacement of the grooved roller 3 measured by the grooved-roller-displacement-measuring unit 15 such that the temperature and the flow rate of the cooling water are adjusted by the cooling-water-adjusting unit 16 based on that data. Furthermore, the amount of axial displacement of the ingot measured by the ingot-displacement-measuring mechanism 11 is taken into consideration when the temperature and the flow rate of the cooling water are adjusted, and a program is written so that the amount of axial displacement of the grooved roller 3 is ultimately controlled so as to correspond to the amount of displacement of the ingot.

Incidentally, the computer 18 can be connected to the thermocouple 13 or the differential displacement gage 14 in the ingot-displacement-measuring mechanism 11 and, at the same time, connected to the roller-displacement-measuring unit 15 and the cooling-water-adjusting unit 16 in the grooved-roller-displacement-control mechanism 12. By doing so, it is possible to process data on the ingot and the grooved roller 3 collectively, making it possible to perform processing with ease and efficiency. In addition, this helps save space compared with a case in which separate computers are provided for the mechanisms 11 and 12, making it possible to achieve space saving.

The number of computers, or the like, may be determined according to their processing power, space, and the like.

With the above wire saw apparatus 1 of the invention, it is possible to change the grooved roller 3 in synchronism with a change in the ingot during slicing. That is, for example, even when the ingot thermally expands at the time of slicing and extends toward the both sides in an axial direction, it is possible to extend the grooved roller 3 toward the both sides in an axial direction by adjusting the cooling water. This makes it possible to displace the position of each wire slicing the ingot toward the both sides of the grooved roller 3 in the axial direction. At this time, by writing a program so as to control the amount of axial displacement of the grooved roller 3 so that the position of each wire is displaced by an amount equal to the amount of axial displacement in each position where the ingot is sliced, the relative position of the wire relative to the entire length of the ingot is uniformly adjusted, whereby a slicing path becomes flattened. As a result, it is possible to obtain excellent wafer in which a Bow or the like is reduced.

Next, a procedure for performing the slicing method of the invention by using the above-described wire saw apparatus 1 will be described. Incidentally, hereinafter, a method for controlling the amount of axial displacement of the grooved roller 3 so that a slicing path becomes flattened will be described, however, the method is not limited thereto. It is possible to make an appropriate modification so as to obtain an intended slicing path.

First, by the ingot-feed mechanism 5, an ingot held thereby is fed downward at a predetermined speed, and the grooved roller 3 is driven such that the wire 2 provided with tension by the wire-tension-providing mechanism 4 is made to travel in the reciprocating direction. Incidentally, the magnitude of the tension to be provided to the wire 2, the travelling speed of the wire 2, and the like, can be appropriately set. For example, the wire 2 can be provided with a tension of 2.5 kgf to 3.0 kgf and made to travel in the reciprocating direction at an average speed of 400 m/min to 600 m/min in a cycle of 1 c/min to 2 c/min (30 s/c to 60 s/c). Such conditions may be determined according to an ingot to be sliced, or the like.

Moreover, spraying of slicing slurry on the grooved rollers 3 and the wire 2 is started, whereby the slicing of the ingot is performed.

When slicing is performed in the manner as described above, the influence of frictional heat caused by slicing, the slurry, or the like, produces thermal expansion/contraction. This results in a change in an axial direction and the formation of a slicing path as shown in FIG. 14(C), for example, in the ingot itself.

Figure 14:
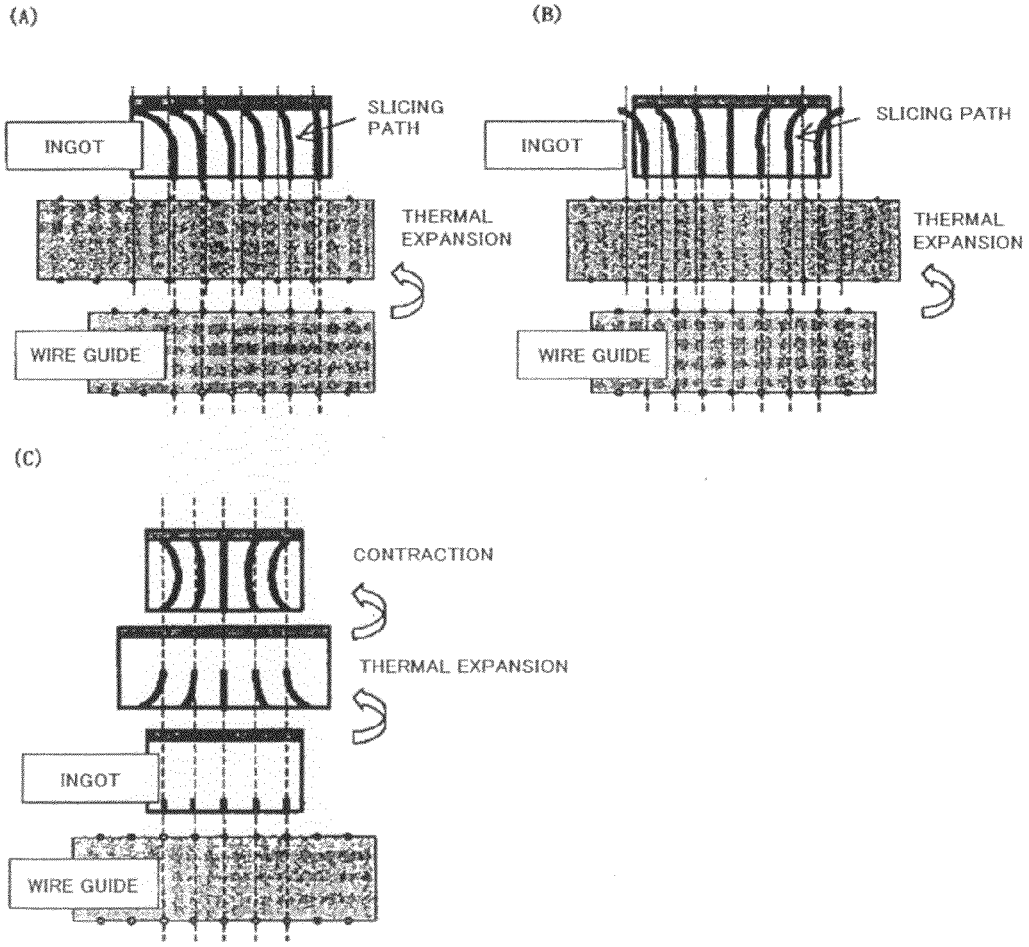
FIG. 14(A) is an explanatory diagram showing an example of thermal expansion (one direction) of the grooved roller and a slicing path when an ingot is sliced. (B) is an explanatory diagram showing an example of thermal expansion (front-back direction) of the grooved roller and a slicing path when an ingot is sliced. (C) is an explanatory diagram showing an example of thermal expansion/contraction of an ingot and a slicing path when the ingot is sliced.

On the other hand, thermal expansion also occurs in the grooved roller 3, resulting in a change in an axial direction as shown in FIG. 14(B), for example, and affecting the slicing path of the ingot.

Therefore, these changes are combined to result in a slicing path shown in FIG. 15(B), and a Bow or the like is generated in the wafer thus obtained.

Figure 4:
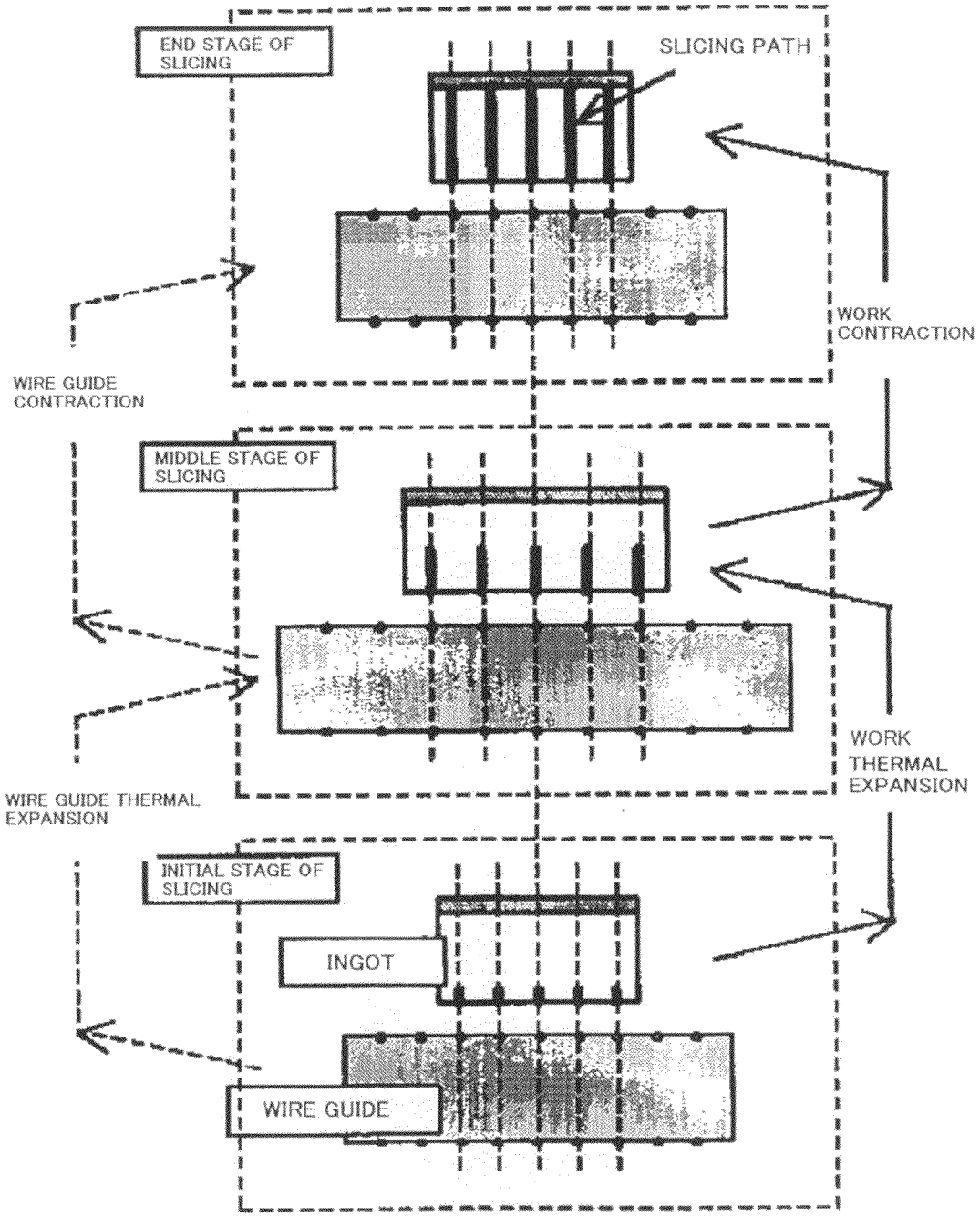
FIG. 4 is an explanatory diagram showing the relationship between changes in an ingot and a grooved roller in an axial direction in a slicing method of the invention.
Figure 5:
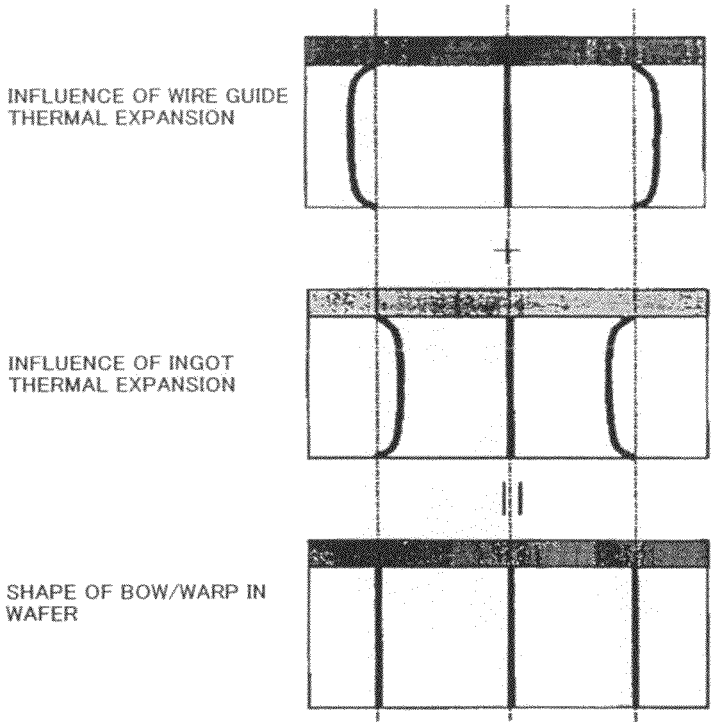
FIG. 5 is an explanatory diagram showing an example of a slicing path when thermal expansion (front-back direction) of a grooved roller and thermal expansion/contraction of an ingot when the ingot is sliced according to the invention are taken into consideration.

Therefore, to flatten the slicing path, as in the slicing method of the invention, as shown in the relationship between changes in the ingot and the grooved roller in an axial direction in FIG. 4, the amount of axial displacement of the grooved roller 3 is controlled so as to correspond to the amount of axial displacement of the ingot. That is, the grooved roller 3 is also made to expand thermally in a similar manner in accordance with the thermal expansion of the ingot, and the grooved roller 3 is made to contract when the ingot contracts. At this time, by controlling the amount of displacement of the grooved roller 3, the relative position of the wire relative to the entire length of the ingot is adjusted so as to be constant. As a result of the influence of the above-described thermal expansion of the ingot on the slicing path and the control of the grooved roller 3 (the influence of the thermal expansion of the grooved roller 3), it is possible to flatten the slicing path ultimately obtained as shown in FIG. 5, and reduce a Bow or the like.

Hereinafter, the above-described changes in the ingot and the grooved roller 3 in an axial direction during slicing and the control will be described more specifically.

First, the amount of axial displacement of the ingot during slicing is measured by the ingot-displacement-measuring mechanism 11. This measurement can be performed by a measuring method using the thermocouple 13, the differential displacement gage 14, or the like. All that is needed is to measure the amount of displacement of the ingot accurately and quickly.

Figure 6:
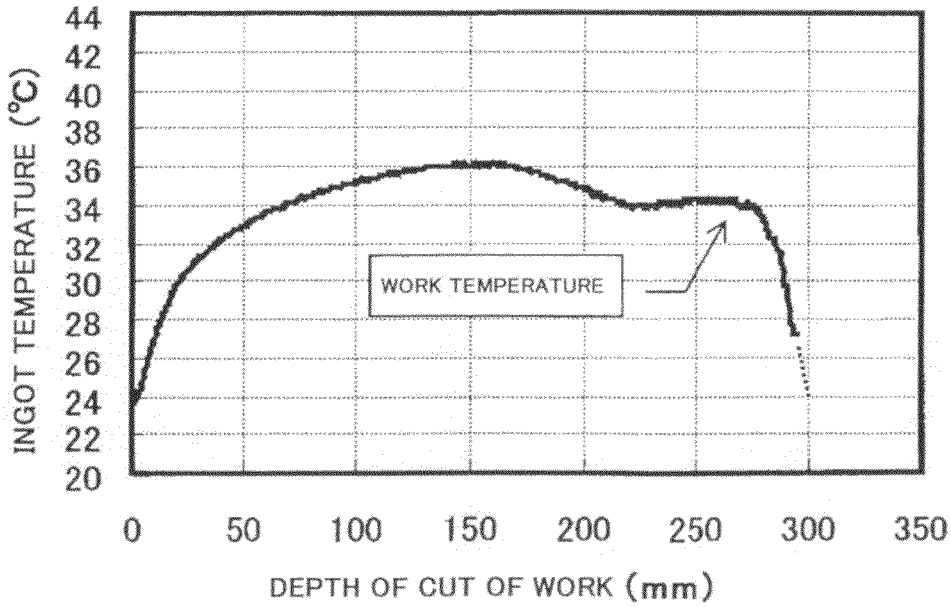
FIG. 6 is a graph showing an example of the temperature of an ingot relative to the depth of cut, the temperature measured by using a thermocouple.

Incidentally, in FIG. 6, an example of a change in the temperature of the ingot relative to the depth of cut, when the change is measured by using the thermocouple 13, is shown. It is apparent that the temperature increases until the depth of cut reaches about a half (150 mm), then gradually decreases, and finally decreases rapidly (that is, it is apparent that, as shown in FIG. 14(C), after the occurrence of thermal expansion once, contraction occurs). By using such temperature data and a coefficient of linear expansion of a material of the ingot, it is possible to calculate the amount of axial displacement of the ingot relative to the depth of cut.

The data measured by the thermocouple 13 or the differential displacement gage 14 or the like is processed by the computer 18.

On the other hand, also in the grooved roller 3, the amount of axial displacement of the grooved roller 3 is measured by using the eddy-current sensor 17, for example by the grooved-roller-displacement-measuring unit 15 in the grooved-roller-displacement-control mechanism 12. This measured data is also processed by the computer 18.

Then, the amount of axial displacement of the grooved roller 3 to be controlled is determined by the computer 18 so as to correspond to the amount of axial displacement of the ingot. That is, in this case, to flatten the slicing path, the amount of axial displacement of the grooved roller 3 is determined such that the position of each wire wound around the grooved roller 3 is displaced in an axial direction by an amount equal to the amount of axial displacement in each position where the ingot is sliced. That is, the amount of displacement of the grooved roller 3 by which the relative position of the wire relative to the changing entire length of the ingot is adjusted to be constant is derived.

Based on the determined amount of axial displacement, actual control of the amount of displacement of the grooved roller 3 is performed by the cooling-water-adjusting unit 16. The temperature or the flow rate of the cooling water passed through the shaft (shaft center) of the grooved roller 3 is adjusted by the cooling-water-adjusting unit 16, whereby the temperature of the grooved roller 3 is adjusted and the amount of axial displacement is controlled.

Incidentally, the relationship between the temperature and the flow rate of the cooling water and the amount of axial displacement of the grooved roller 3 may be obtained by previously performing an experiment.

Figure 7:
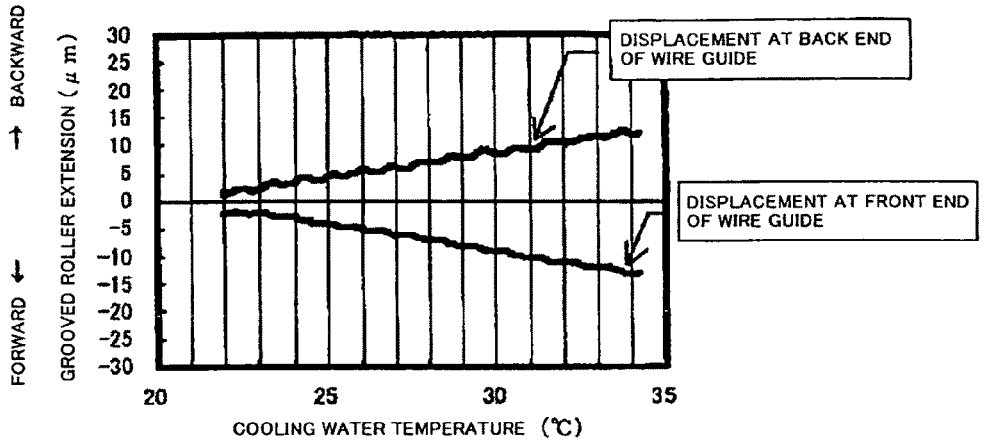
FIG. 7 is a graph showing an example of the relationship between the temperature of cooling water and the amount of displacement of a grooved roller 3, the relationship obtained by a preliminary experiment.

In FIG. 7, a graph of the relationship between the temperature of the cooling water and the amount of displacement of the grooved roller 3, the relationship obtained by a preliminary test, is shown. An upper line of FIG. 7 represents the amount by which the grooved roller 3 extends backward, and a lower line represents the amount by which the grooved roller 3 extends forward. It is apparent that, as the temperature of the cooling water increases, the amount by which the grooved roller 3 extends forward and backward increases. That is, it is apparent that all that is needed is to increase the temperature of the cooling water to extend the grooved roller 3 toward the both sides, and decrease the temperature of the cooling water to make the grooved roller 3 contract.

For also the flow rate of the cooling water, an appropriate test may be performed previously in the same manner, and thereby investigating the relationship between a change in the flow rate and the amount of axial displacement of the grooved roller 3.

Furthermore, it is also possible to perform a preliminary test on a change in the grooved roller 3 not only in a case in which only the temperature or the flow rate of the cooling water is changed, but also in a case in which these changes are combined.

Then, based on the results of these preliminary tests, the temperature or the flow rate of the cooling water corresponding to an intended amount of displacement of the grooved roller 3 is determined.

In this way, the amount of axial displacement of the grooved roller 3 is controlled by adjusting the temperature or the flow rate of the cooling water by feeding the amount of axial displacement of the grooved roller 3 back to the cooling-water-adjusting unit 16.

As described above, it is possible to control the amount of axial displacement of the grooved roller 3 according to moment-to-moment changes in the ingot in an axial direction caused by thermal expansion.

It is to be noted that the reproducibility of the amount of thermal expansion of the ingot is extremely high depending on the slicing conditions and the dimensions of the ingot. Thus, with consideration given thereto, it is also possible to generate a profile of the amount of axial displacement of the ingot measured by the above-described method relative to the depth of cut of the ingot, make the computer 18 or the like store it, and control the amount of axial displacement of the grooved roller 3 based on this profile. Such a control method makes it possible to perform control of the grooved roller 3 with extreme ease, making it possible to achieve an improvement in efficiency.

Hereinafter, the invention will be explained in more detail by Example; the invention, however, is not limited thereto.

EXAMPLE

The slicing method of the invention was carried out by using the wire saw apparatus 1 of the invention shown in FIG. 1. A silicon ingot having a diameter of 300 mm was sliced by spraying slurry on the wire and the grooved rollers under the slicing conditions shown in the following Table 1.

For measuring the amount of thermal expansion of the ingot, as shown in FIG. 2(A), a thermocouple was fixed at both ends of the ingot in a position at a depth of cut of 285 mm with an epoxy adhesive, whereby the temperature of the ingot was measured, and the amount of thermal expansion was obtained by multiplying the temperature by a coefficient of linear thermal expansion of silicon, $2.3\times10^{-6}/°$ C.

Incidentally, a change in the temperature of the ingot relative to the depth of cut during slicing was almost the same as that shown in FIG. 6.

Then, while slicing was performed, the grooved rollers 3 were displaced in an axial direction at each depth of cut at the same rate as the amount of axial displacement of the ingot obtained by the above-described measuring method by adjusting the temperature of the cooling water passed through the shaft of the grooved rollers 3. That is, slicing was performed by displacing the position of the wire by a corresponding amount in an axial direction of the grooved rollers 3 in accordance with the amount of displacement of the ingot changing in an axial direction, while performing control so as to make the relative position of the wire constant relative to the entire length of the ingot so that a slicing path became flattened.

Incidentally, the relationship between the temperature of the cooling water and the amount of displacement of the grooved roller 3, the relationship obtained by a preliminary test, was almost the same as the relationship shown in FIG. 7.

TABLE 1

| | | Slicing condition |
|---|---|---|
| Wire saw apparatus (main body unit) | | Toyo Advanced Technologies |
| Work | Ingot diameter | ϕ300 mm |
| Wire | Wire diameter | 160 μm |
| | Wire tension | 2.5 kgf |
| | New wire feed rate | 100 m/min |
| | Wire inversion cycle | 60 s |
| | Wire traveling speed | Ave. 500 m/min |
| Slurry | Abrasive grain | GC#1000 |
| | Abrasive grain concentration (coolant:abrasive grain) | 50:50 (ratio by weight) |
| | Slurry temperature | 23° C. (constant) |

Figure 8:
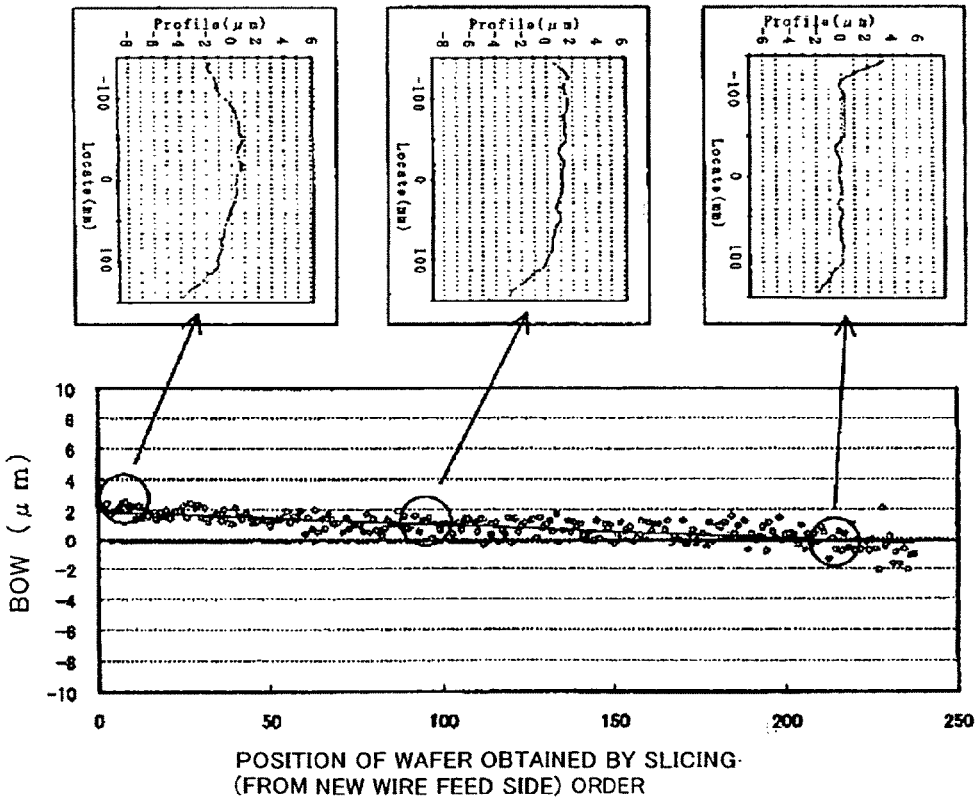
FIG. 8 is a graph showing the result of the measurement of Bows/Warps in a wafer obtained by slicing in Example.

In FIG. 8, the result of the measurement of Bows, the result obtained by actually performing shape measurement on all wafers obtained by slicing in Example, is shown (a lower graph in FIG. 8). Incidentally, upper graphs in FIG. 8 represent typical examples of the shape of a Bow/Warp in the wafers obtained by slicing out in the front, middle, and back in an axial direction of the ingot. As shown in FIG. 8, it is apparent that Bows in the wafer are concentrated in the range of −2 μm to +2 μm. As described above, in Example, it was possible to obtain a wafer with an extremely small Bow by slicing out compared with Comparative Example, which will be described later. This is because, as is understood from the upper graphs in FIG. 8, the wire saw apparatus and the slicing method of the invention make it possible to achieve a relatively flat slicing path.

Comparative Example 1

An ingot was sliced in the same manner as in Example 1 except that a conventional wire saw apparatus (a type that can extend back and forth in an axial direction) was used, and the cooling water was passed through the grooved rollers with the temperature or the flow rate thereof kept constant without measuring the amount of thermal expansion of the ingot or the grooved rollers during slicing and without taking it into account.

Figure 9:
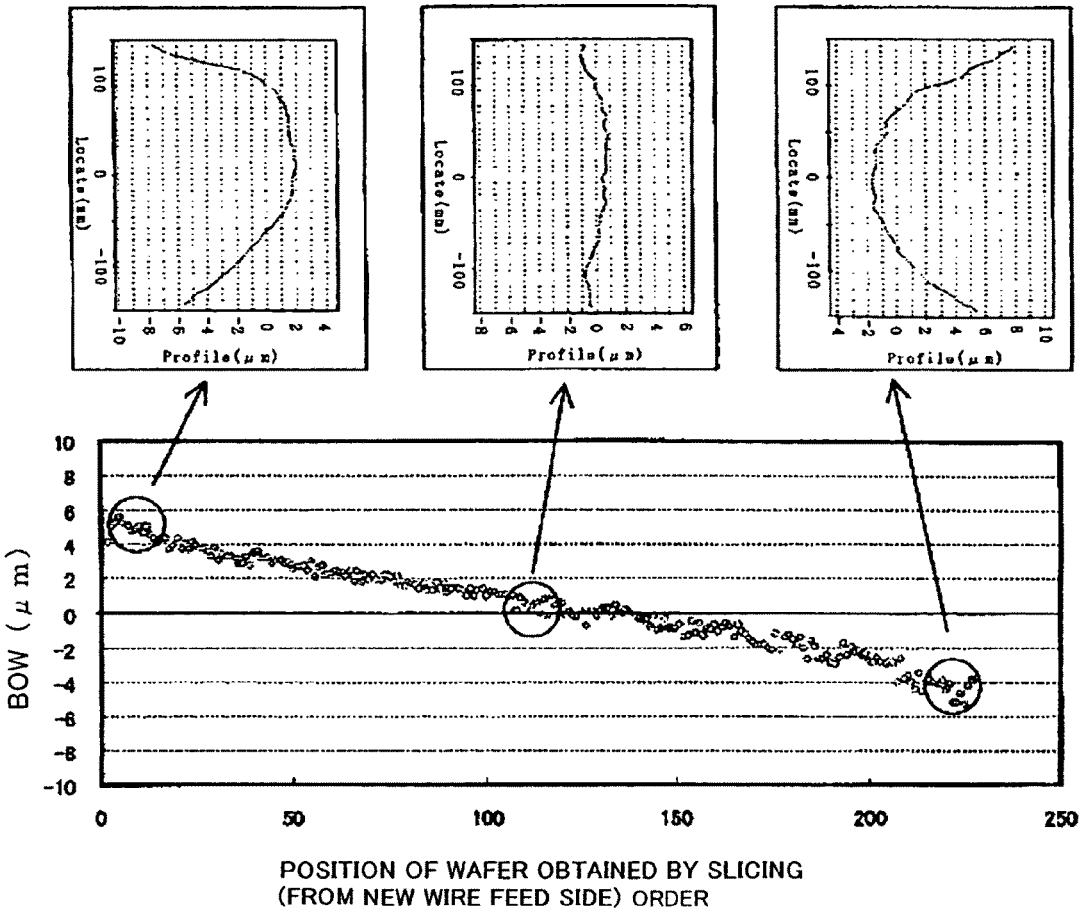
FIG. 9 is a graph showing the result of the measurement of Bows/Warps in a wafer obtained by slicing in Comparative Example 1.

In FIG. 9, the result of the measurement of Bows, the result obtained by actually performing shape measurement on all wafers obtained by slicing out in Comparative Example 1, is shown. As shown in FIG. 9, it is apparent that Bows in the wafers are concentrated in the range of −5 μm to +6 μm, and the absolute value of a Bow value is three or more times higher than that of Example (−2 μm to +2 μm).

Comparative Example 2

An ingot was sliced in the same manner as in Comparative Example 1 except that a conventional wire saw apparatus (a type that can extend in only one direction in the axial direction) was used.

Figure 10:
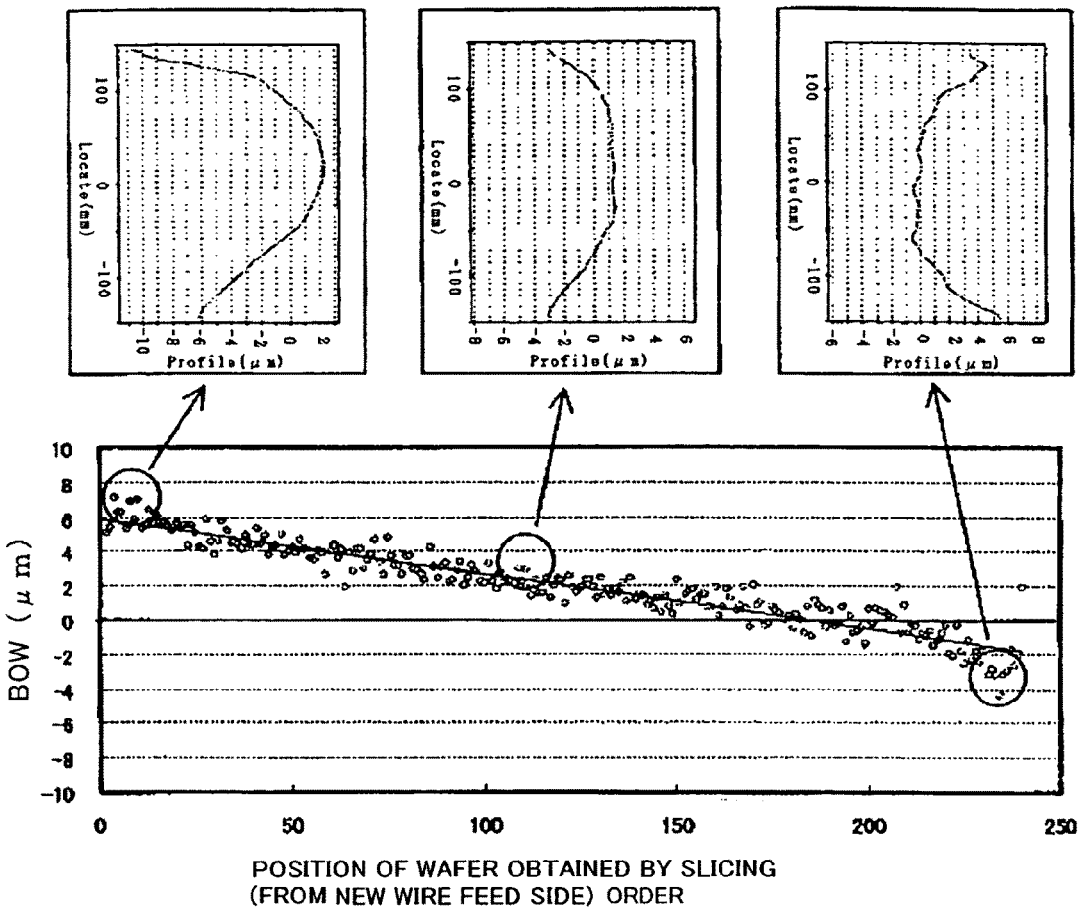
FIG. 10 is a graph showing the result of the measurement of Bows/Warps in a wafer obtained by slicing in Comparative Example 2.

In FIG. 10, the result of the measurement of Bows, the result obtained by actually performing shape measurement on all wafers obtained by slicing in Comparative Example 2, is shown. As shown in FIG. 10, it is apparent that Bows in the wafer are concentrated in the range of −2 μm to +8 μm, which is also wider than that of Example (−2 μm to +2 μm), and the absolute value becomes high. Incidentally, due to the difference in type of a grooved roller, Bows are tilted toward a plus side.

Comparative Example 3

An ingot was sliced in the same manner as in Comparative Example 1 except that a conventional wire saw apparatus (a type that can extend in only one direction in the axial direction) was used, and slurry was sprayed also on the ingot during slicing in order to suppress axial displacement of the ingot. Incidentally, the temperature of the slurry sprayed on the ingot was kept constant at 23° C.

Figure 11:
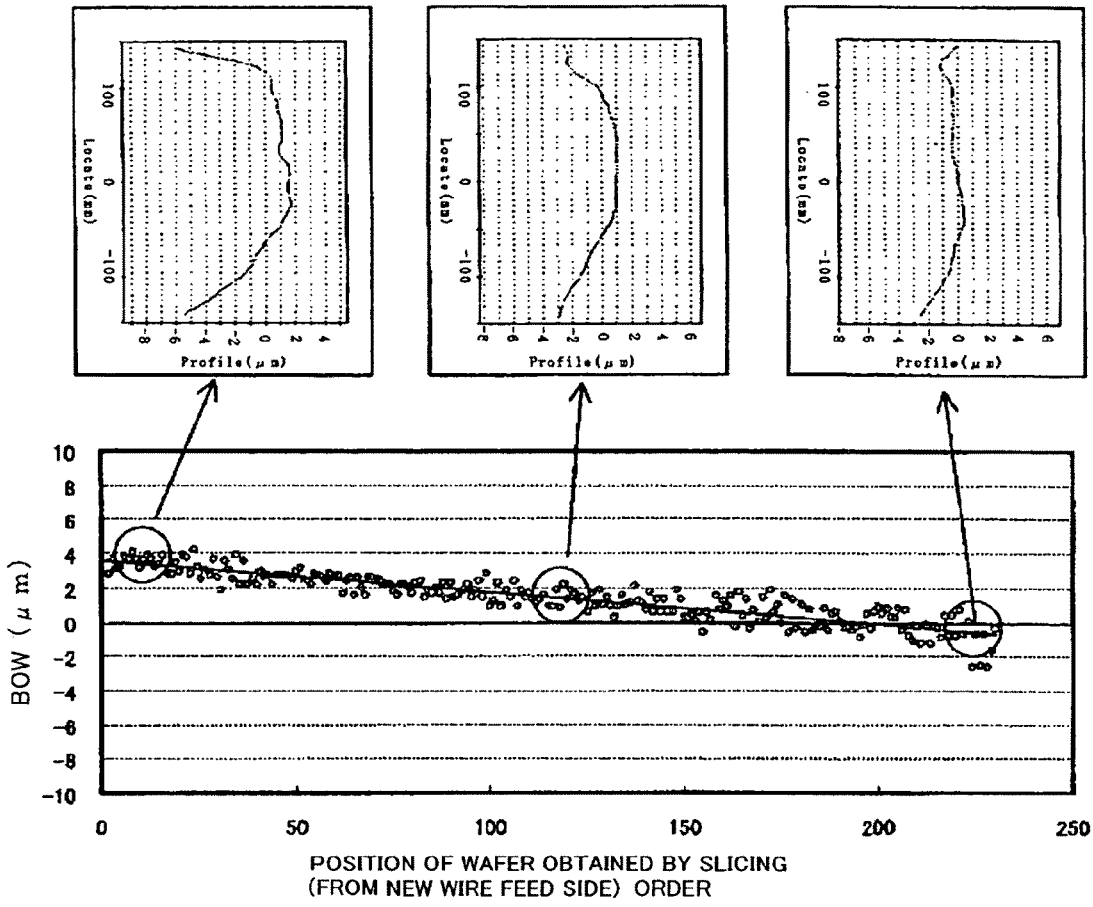
FIG. 11 is a graph showing the result of the measurement of Bows/Warps in a wafer obtained by slicing in Comparative Example 3.

In FIG. 11, the result of the measurement of Bows, the result obtained by actually performing shape measurement on all wafers obtained by slicing out in Comparative Example 3, is shown. As shown in FIG. 11, the result reveals that Bows in the wafer are concentrated in the range of −2 μm to +4 μm, which is wider than that of Example (−2 μm to +2 μm). This is because, although a change in the ingot in an axial direction, the change caused by thermal expansion, is slightly reduced by spraying the slurry on the ingot, it is impossible to reduce the change to zero completely, and a Bow or the like in the wafer obtained by slicing out is, after all, only partially alleviated.

It is to be understood that the present invention is not limited in any way by the embodiment thereof described above. The above embodiment is merely an example, and anything that has substantially the same structure as the technical idea recited in the claims of the present invention and that offers similar workings and benefits falls within the technical scope of the present invention.

The invention claimed is:

1. A method for slicing an ingot in a form of a wafer, the method comprising:

providing a plurality of grooved rollers, each grooved roller having a hollow shaft extending into the roller;

winding a wire around the plurality of grooved rollers and pressing the wire against the ingot while making the wire travel; and supplying slurry to the grooved rollers;

slicing the ingot;

wherein during said slicing, measuring an amount of displacement of the ingot changing in an axial direction;

generating a profile of the amount of axial displacement of the ingot relative to a depth of slicing, wherein the profile is generated from the measured amount of axial displacement of the ingot, and, based on the profile thus generated, controlling an amount of axial displacement of the grooved rollers by passing cooling water through the hollow shafts of the grooved rollers and adjusting a temperature and/or flow rate of the cooling water, the cooling water extending into the hollow shafts at least to the extent of all the grooves, and thereby slicing the ingot while controlling a relative position of the wire relative to an entire length of the ingot changing in the axial direction.

2. The slicing method according to claim 1, wherein the measurement of the amount of axial displacement of the ingot is performed by using a thermocouple or a differential displacement gage.

3. A wire saw apparatus comprising a plurality of grooved rollers, each grooved roller having a hollow shaft extending into the roller; a wire wound around the plurality of grooved rollers for slicing an ingot in a form of a wafer by pressing the wire against the ingot while making the wire travel and supplying slurry to the grooved rollers, the wire saw apparatus further comprising:

an ingot displacement measuring mechanism for measuring an amount of axial displacement of the ingot being sliced; and a grooved roller displacement control mechanism for controlling an amount of axial displacement of the grooved rollers, based on a profile of the amount of axial displacement of the ingot relative to a depth of cut generated from the amount of axial displacement of the ingot measured by the ingot displacement measuring mechanism, whereby the amount of axial displacement of the rollers is controlled by adjusting a temperature and/or a flow rate of cooling water that is passed through the hollow shafts of the grooved rollers, the cooling water extending into the hollow shafts at least to the extent of all the grooves.

* * * * *